US005778776A

United States Patent [19]

Fuwa et al.

[11] Patent Number: 5,778,776

[45] Date of Patent: Jul. 14, 1998

[54] STENCIL STAMP UNIT

[75] Inventors: Tetsuji Fuwa, Hashima; Teruo Imamaki, Kasugai; Takashi Okumura, Nagoya, all of Japan

[73] Assignee: Brother Kogyo Kabushiki Kaisha, Nagoya, Japan

[21] Appl. No.: 726,857

[22] Filed: Oct. 4, 1996

[30] Foreign Application Priority Data

Oct. 5, 1995 [JP] Japan ..... 7-286640

[51] Int. Cl.[6] ..... B41L 27/26

[52] U.S. Cl. ..... 101/125; 101/333

[58] Field of Search ..... 101/125, 127.1, 101/128.4, 327, 333, 379

[56] References Cited

U.S. PATENT DOCUMENTS

| | | | |
|---|---|---|---|
| 2,020,151 | 11/1935 | Madden | 101/125 |
| 3,832,947 | 9/1974 | Funahashi | 101/327 |
| 4,441,422 | 4/1984 | Dreeben | 101/125 |
| 4,996,921 | 3/1991 | Hong | 101/333 |
| 5,115,729 | 5/1992 | Beckman et al. | 101/327 |
| 5,377,599 | 1/1995 | Wall et al. | 101/327 |

FOREIGN PATENT DOCUMENTS

| | | |
|---|---|---|
| 5-41843 U | 6/1993 | Japan . |
| A-7-149034 | 6/1995 | Japan . |

*Primary Examiner*—Christopher A. Bennett
*Attorney, Agent, or Firm*—Oliff & Berridge PLC

[57] ABSTRACT

A stamp device including a stamp body including a grip portion at an upper end thereof and a base portion at a lower end thereof; an ink impregnated body impregnated with ink and attached to the base portion of the stamp body; a thermal stencil sheet disposed on the stamp body so as to cover the ink impregnated body; a skirt member fitted around the lower end of the stamp body; and a mechanism for maintaining intimate contact between the thermal stencil sheet and the stamp body.

19 Claims, 15 Drawing Sheets

STENCIL STAMP UNIT

BACKGROUND OF THE INVENTION

1. Field of the Invention

The present invention relates to a stamp unit including a stamp body; an ink impregnated body fitted in the stamp body; and a thermal stencil sheet formed with a stencil image and covering the ink impregnated body.

2. Description of the Related Art

There has been known a stamp unit including a stamp body having a grip portion at its upper portion; an ink impregnated body fitted to a lower portion of the stamp body; and a thermal stencil sheet formed with a stencil image and fitted in intimate contact with the under surface of the ink impregnated body. Stencil images can be printed using the stamp unit by pressing the stencil sheet and the ink impregnated body against a medium to be printed on. The stencil image can either be formed in the stencil sheet after the stencil sheet is attached to the under surface of the ink impregnated body or can be formed in the stencil sheet first and the stencil sheet fixed to the under surface of the ink impregnated body afterward.

For example, U.S. patent application Ser. No. 08/337,215 filed on Nov. 7, 1994 based on Japanese Patent Application (KOKAI) No. HEI-7-149034, which was laid open to the public on Jun. 13, 1995, describes a stamp unit wherein a print portion of a stencil sheet covers an ink impregnated member. An outer peripheral portion of the stencil sheet is adhered to the side surfaces of a stamp body. A skirt member is fitted to the stamp body from below. The stamp unit is mounted into a special thermal perforation device with a thermal head to thermally form a stencil image into the print portion of the stencil sheet. However, in the case of this stamp unit, the special thermal perforation unit must be provided to thermally perforate the stencil image in the stencil sheet.

Japanese Utility Application (Kokai) No. HEI-5-41843 describes a stamp unit wherein an ink impregnated body is attached to the lower surface of a stamp body. A stencil sheet formed with a perforation stencil image is adhered to the lower edge of a frame-shaped skirt member. By fitting the skirt member from below the stamp body, the stencil sheet is brought into intimate contact with the lower surface of the ink impregnated body, thereby forming the stamp unit. To print a stencil image using the stamp unit, a user grasps a grip at the upper portion of the stamp body, and presses the ink impregnated body and the stencil sheet against the object to be printed on.

There have been also known a type of label producing thermal printer for producing a variety of labels by printing on tape-shaped thermal sheets. The label producing thermal printer can be used to form a stencil image in a tape-shaped stencil sheet by perforating the stencil sheet. The perforated stencil sheet can then be used with the above-described stamp unit by cutting the tape-shaped stencil sheet perforated with a stencil image into a sheet shape and pressing it against the ink impregnated body fixed to the lower portion of the stamp body. Viscosity of ink impregnating the ink impregnated body holds the stencil sheet in intimate contact with the lower surface of the ink impregnated body.

SUMMARY OF THE INVENTION

However, in this stamp unit, the stencil sheet formed by cutting a tape-shaped stencil sheet into a sheet shape has the same width as the ink impregnated body and is adhered to the lower surface of the ink impregnated body by clinging force of the ink only. Because the stencil sheet and the ink impregnated body are held together by this weak clinging force only, the stencil sheet would easily peel off the ink impregnated body. Also, because the stencil sheet extends only to the side edges of the ink impregnated body, and does not cover the side surfaces of the ink impregnated body, when the stencil sheet and the ink impregnated body are pressed against the medium to be printed on, ink will seep out of the stamp unit from between the stencil sheet and the edges of the ink impregnated body. On the other hand, the stamp unit described in Japanese Utility Model Application No. HEI-5-41843, can prevent ink from leaking out of the ink impregnated body. However, the stencil sheet is difficult to attach to the skirt member because it is extremely thin and is adhered only by its outer peripheral edge to the narrow frame-shaped bottom edge of the skirt member. Also, because the stencil sheet is adhered to the frame-shaped portion by only a small surface area, the stencil sheet can be easily peeled away from the skirt member.

It is an objective of the present invention to overcome the above-described problems and to provide a stamp unit wherein a thermal stencil sheet formed with a stencil image can be easily and reliably mounted to an ink impregnated body without the thermal stencil sheet peeling away from the ink impregnated body and without ink leaking from the ink impregnated body.

To achieve the above-described objectives, a stamp device according to the present invention includes a stamp body including a grip portion at an upper end thereof and a base portion at a lower end thereof; an ink impregnated body impregnated with ink and attached to the base portion of the stamp body; a thermal stencil sheet disposed on the stamp body so as to cover the ink impregnated body; a skirt member fitted around the lower end of the stamp body; and a mechanism for maintaining intimate contact between the thermal stencil sheet and the stamp body.

Because the stencil sheet is attached to the stamp body in the manner described above, ink will not leak from the ink impregnated body. Also, because the outer peripheral portion of the thermal stencil sheet is strongly mounted to the entire periphery of the stamp body, the thermal stencil sheet will not peel away from the ink impregnated body. Also, the thermal stencil sheet can be easily and reliably attached to the stamp body using the adhesive and skirt member.

According to another aspect of the present invention, an engagement mechanism is provided to support the stamp body between a first position, wherein the print portion protrudes from the opening portion, and a second position, wherein the print portion is retracted within the opening portion. With this configuration, printing can be performed with the print portion protruding out of the opening portion and when the stamp unit is not being used, it can be stored with the print portion retracted within the opening portion so that ink will not be accidently printed on the surfaces of other objects. Also, the print portion will not be stained.

This engagement mechanism can be easily produced by forming a pair of engaging portions to the side wall of the stamp body and a pair of engaged portions to the side wall of the skirt member.

According to another aspect of the present invention a support portion can be provided to the skirt member for supporting the thermal stencil sheet when the skirt member is fitted onto the stamp body. When supported by the support portion, the thermal stencil sheet can be easily and reliably brought into intimate contact with the lower and outer peripheral surfaces of the ink impregnated body so that ink leaks from the ink impregnated body can be reliably prevented.

When the skirt member is fitted to the lower portion of the stamp body while the thermal stencil sheet is attached to the lower surface of the ink impregnated body, the thermal stencil sheet can be easily and reliably brought into intimate contact with the lower and outer peripheral surfaces of the ink impregnated body, so that ink can be reliably prevented from leaking out of the ink impregnated body.

BRIEF DESCRIPTION OF THE DRAWINGS

The above and other objects, features and advantages of the invention will become more apparent from reading the following description of the preferred embodiment taken in connection with the accompanying drawings in which:

FIG. 19(*b*) is a cross-sectional view showing the stamp device of FIG. 18 with the cap mounted thereto.

DETAILED DESCRIPTION OF THE PREFERRED EMBODIMENTS

Figure 1:
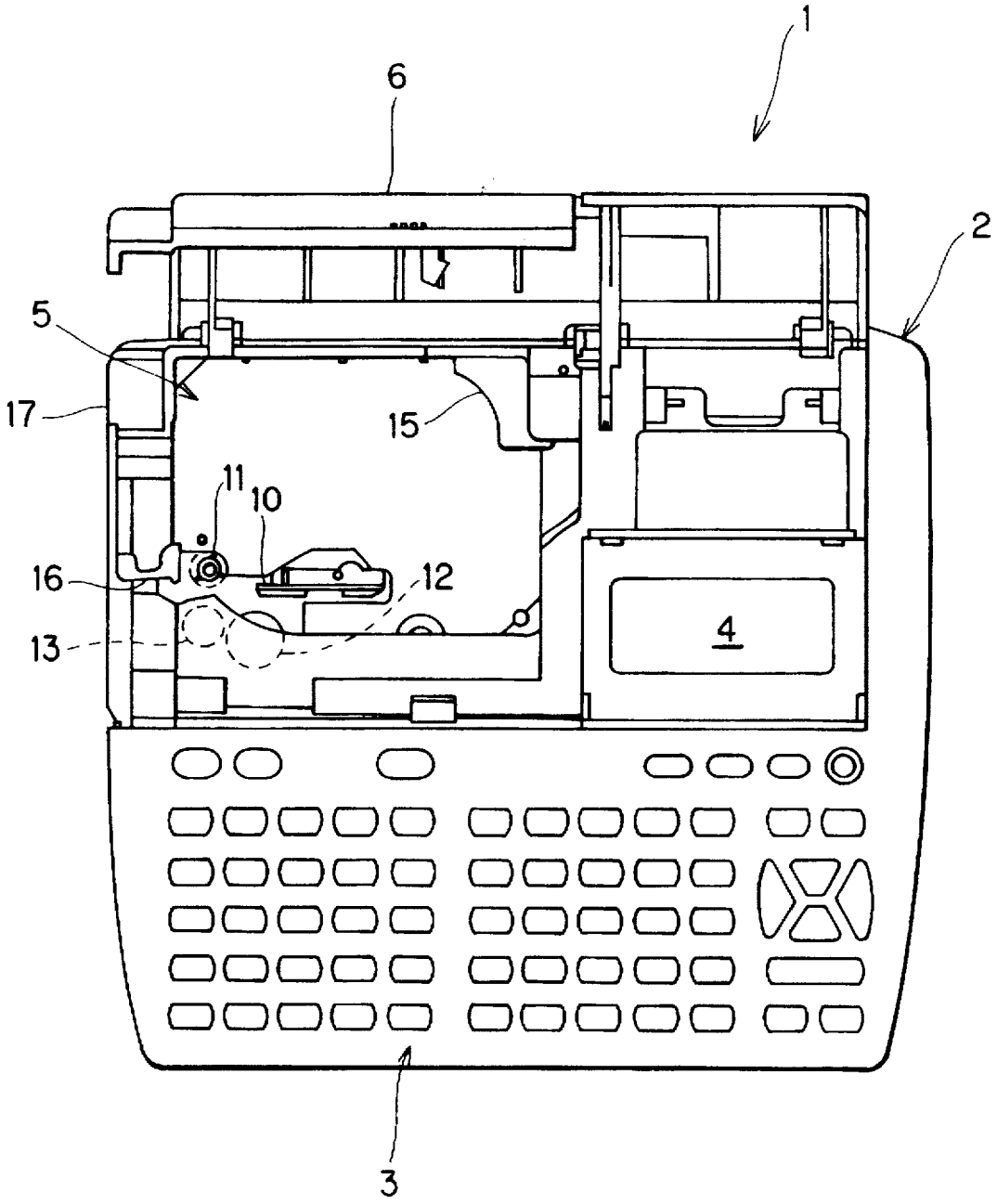
FIG. 1 is a plan view showing a thermal perforating unit for thermally perforating a stencil image in a tape-shaped thermal stencil sheet housed in a stencil cassette.

A stamp unit according to a first embodiment of the present invention will be described while referring to the accompanying drawings wherein like parts and components are designated by the same reference numerals to avoid duplicating description.

The present embodiment describes the present invention applied to a stamp unit attached with an ink impregnated body, a thermal stencil sheet, and a skirt member fitted to the stamp body. The thermal stencil sheet is formed by using a thermal perforating unit to thermally perforate a stencil image in a tape-shaped thermal stencil sheet housed in a stencil cassette and then cutting the tape-shaped thermal stencil sheet to a predetermined length.

First, an explanation will be provided for a thermal perforation unit 1. As shown in FIG. 1, the thermal perforation unit 1 includes a main case 2; a keyboard portion 3 having a variety of function keys, and also character keys for inputting characters and symbols; a liquid crystal display portion 4 capable of displaying characters and symbols inputted via the keyboard portion 3; and a cassette mounting portion 5 for freely detachably mounting a stencil cassette 20 to be described later.

An opening 16 through which a thermal stencil sheet 28 of a stencil cassette 20 is drawn out of the thermal perforation unit 1 is formed to the left side, as viewed in FIG. 1, of the cassette mounting portion 5. An operation lever 17 for a cutter (not shown in the drawings) for cutting the stencil sheet 28 at the opening 16 is also provided to the left side of the cassette mounting portion 5.

A freely openable and closable cover 6 is provided for exposing and covering the cassette mounting portion 5. Various components are provided in the cassette mounting portion 5, including: a thermal head 10 for forming a stencil image in the stencil sheet 28; a platen roller 12; a drive shaft 11 for rotating a tape feed roller 30 of the stencil cassette 20; a pressing roller 13 for transporting the stencil sheet 28; and a cassette detection unit 15 for detecting the type of stencil cassette 20 mounted in the cassette mounting portion 5.

Figure 4:
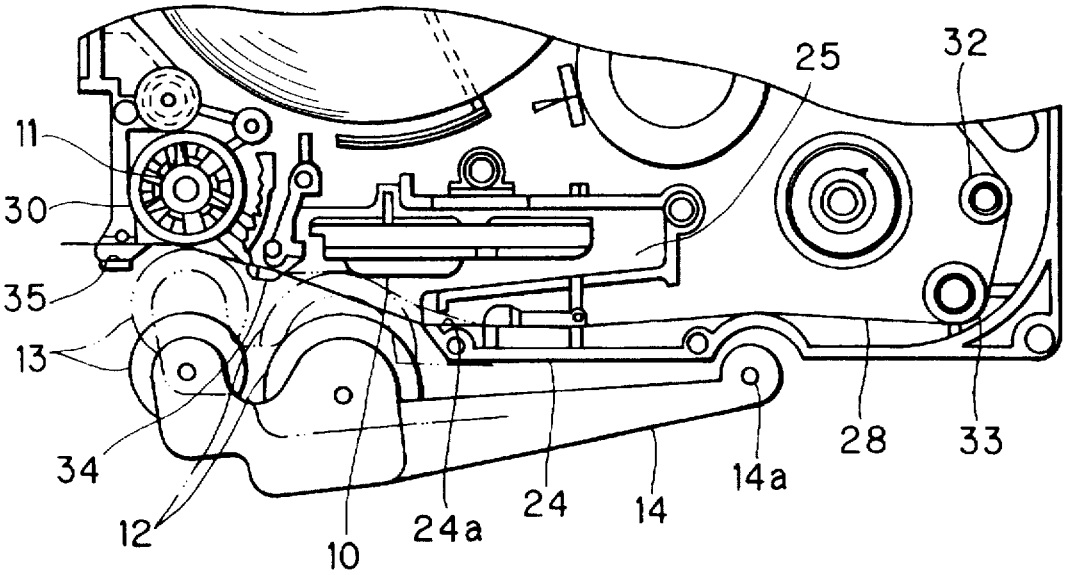
FIG. 4 is a magnified view showing positional relationship of components of the thermal perforating unit and the stencil cassette essential for thermally perforating a stencil image in the stencil sheet.

As shown in FIG. 4, the platen roller 12 and the pressing roller 13 are freely rotatably supported by a pivotable roller holder 14. When the stencil cassette 20 is mounted in the cassette mounting portion 5, the roller holder 14 pivots around a support shaft 14*a* from a position indicated by a solid line to a position indicated by a chain line in FIG. 4. When the roller holder 14 pivots in this manner, the platen roller 12 and the pressing roller 13 press against a thermal head 10 and the tape feed roller 30 respectively via the stencil sheet 28. The stencil sheet 28 is transported by cooperative operation of the tape feed roller 30 and the pressing roller 13 while the thermal head forms a stencil image on the stencil sheet 28.

Figure 2:
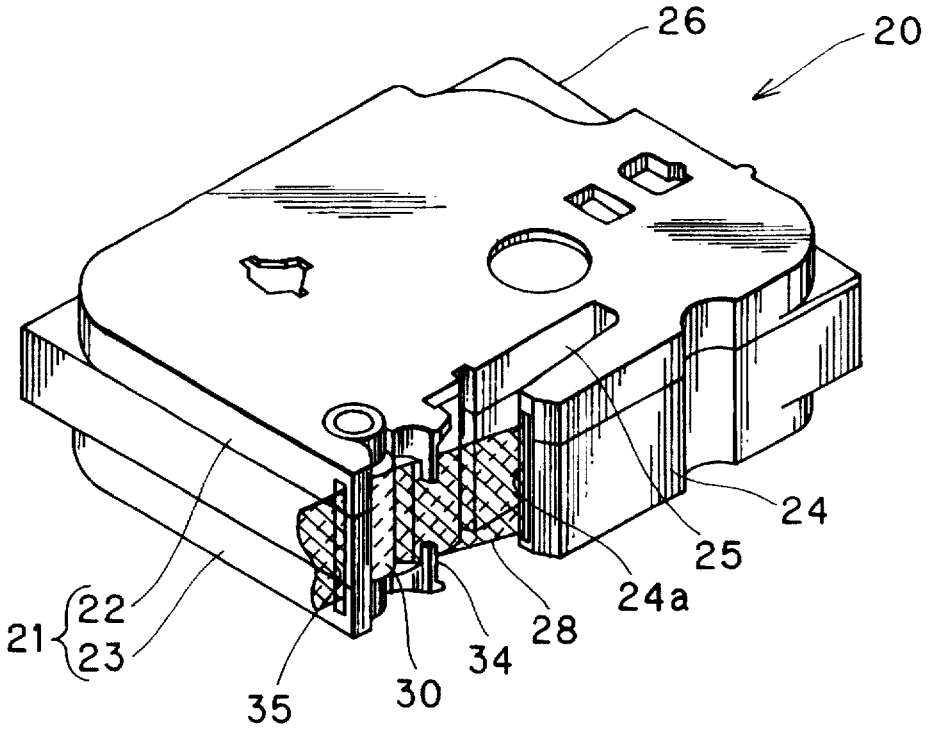
FIG. 2 is a perspective view showing a stencil cassette housing the tape-shaped thermal stencil sheet.

Next, an explanation will be provided for the stencil cassette 20. As shown in FIG. 2, the stencil cassette 20 includes a cassette body 21 having an upper case 22 and a lower case 23. An arm portion 24 having an opening 24*a* and a pawl portion 34 for guiding the stencil sheet 28 are provided to the front edge portion of the cassette body 21. A head mounting portion 25 is formed to the rear side of the arm portion 24. When the stencil cassette 20 is mounted into the cassette mounting portion 5 in a manner to be described later, the thermal head 10 is inserted into the head mounting portion 25. A cassette detection portion 26 is provided to the rear right corner of the cassette body 21. The cassette detection portion 26 indicates the type, that is, the configuration and the width of the stencil sheet housed therein, of the stencil cassette 20 mounted in the cassette mounting portion 5 to a cassette detection unit 15 of the thermal perforation unit 1. The detection unit 15 has a plurality of detection switches.

Figure 3:
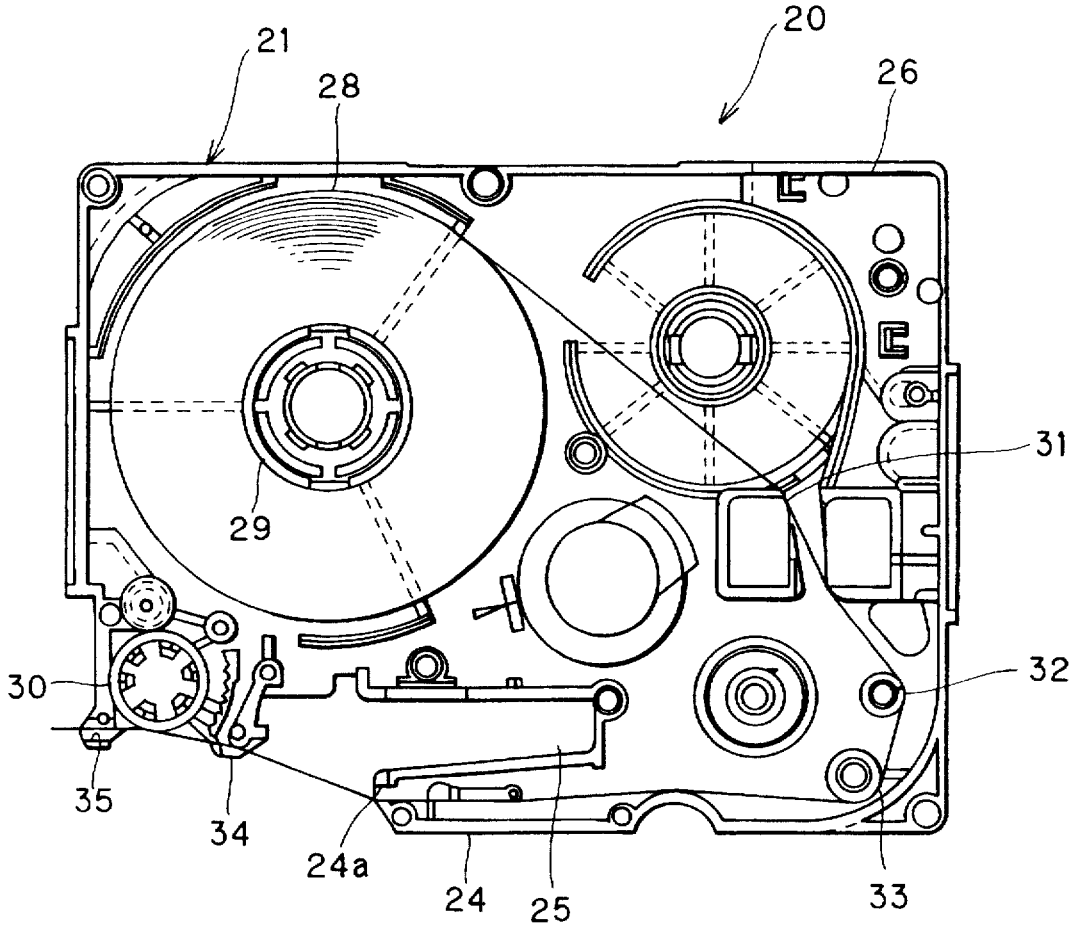
FIG. 3 is a plan view showing the stencil cassette with a top section removed to show internal configuration.

As shown in FIG. 3, a tape spool 29, around which the tape-shaped stencil sheet 28 is wound, and the tape feed roller 30, for transporting the stencil sheet 28, are freely rotatably supported in the cassette body 21. The stencil sheet 28 drawn from the tape spool 29 is guided to the arm portion 28 via a guide portion 31 and guide rollers 32, 33. The stencil sheet 28 drawn out of the opening 24*a* of the arm portion 24 is guided passed the tape feed roller 30 by the pawl portion 34 and out of the stencil cassette 20 through the opening 35.

Figure 5:
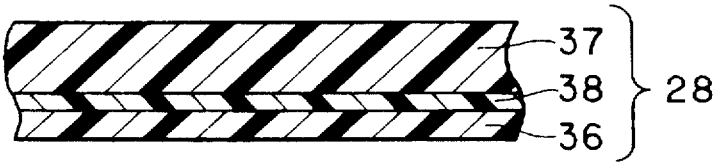
FIG. 5 is a cross-sectional view showing configuration of the stencil sheet.

Next, the stencil sheet 28 will be described in further detail. As shown in FIG. 5, the stencil sheet 28 is formed from a thermal plastic film 36, a porous support body 37, and an adhesive layer 38 adhering the thermal plastic film 36 and the porous supporting body 37 stencil sheet. The stencil sheet 28 housed in the stencil cassette 20 is wound around the tape spool 29 with the porous support body 37 facing outward so that the thermal plastic film 36 will contact the thermal head 10. The thermal plastic film 36 is a thermal plastic compound resin formed to a thickness 1 to 4 μm from, for example, polyethylene terephthalate, polypropylene, or a compound of vinylidene chloride—vinyl chloride. The porous support body 37 is a porous thin sheet formed mainly from a natural fiber with a thickness of 20 to 100 μm, such as Manila hemp, kouzo, or mitsumata; a synthetic fiber, for example, polyethylene terephthalate, polyvinyl alcohol, or polyacrylonitrile; or a semisynthetic fiber such as rayon.

Next, an explanation will be provided for a stamp unit 40. As can best be seen in FIG. 7, the stamp unit 40 includes a stamp body 41 formed from a composite resin in a parallelepiped shape having two parallel lengthwise sides 41*a* and two parallel widthwise sides 41*b*; an ink impregnated body 44 formed from an ink impregnated composite resin foam having a rectangular shape smaller than the bottom surface of the stamp body 41 and attached to the under surface of the stamp body 41; a stencil sheet 28 formed with a stencil image and having a length and width larger than the lower surface of the ink impregnated body 44; and a skirt member 45 freely detachably fitted to the stamp body 41.

The stamp body 41 is formed at its upper surface with a grip portion 42 by which a user can manually grasp the stamp body 41. Engaging portions 51*a* and 51*b*, each having a triangular shape in cross section, are formed in the substantial central portion of opposing inner surfaces of the widthwise sides 41*b* of the stamp body 41 in opposition with each other. An adhesive 43 is coated to the lower portion of both lengthwise sides 41*a* of the stamp body 41. The lengthwise edge portions 28*b* of the stencil sheet 28, previously formed with a stencil image thereon, are adhered to respective sides 41*a* of the stamp body 41 via the adhesive 43.

The skirt member 45 has formed to its lower surface a support lip 47 for supporting the outer peripheral portion of the ink impregnated body 44. An opening portion 46 for exposing the stencil sheet 28 is defined by the inner peripheral surface of the support lip 47. The opening portion 46 is formed in a rectangular shape slightly smaller in both length and width than the lower surface of the ink impregnated body 44. Two engaged portions 52*a* and 52*b* formed from indentations capable of engaging with corresponding ones of the engaging portions 51 are formed in the upper center at the internal surface 45*b* of the skirt member 45.

The stencil sheet 28 has a print portion 28*a* held in intimate contact with the lower surface of the ink impregnated body 44 by viscosity of ink. Each lengthwise edge portion 28*b* of the stencil sheet 28 is adhered via the adhesive 43 to a corresponding one of the lengthwise sides 41*a* of the stamp body 41. Each widthwise edge portion 28*c* of the stencil sheet 28 is folded up at the widthwise edges 41*c* of the stamp body 41 so as to follow along a corresponding one of the widthwise sides 41*b*.

Figure 9:
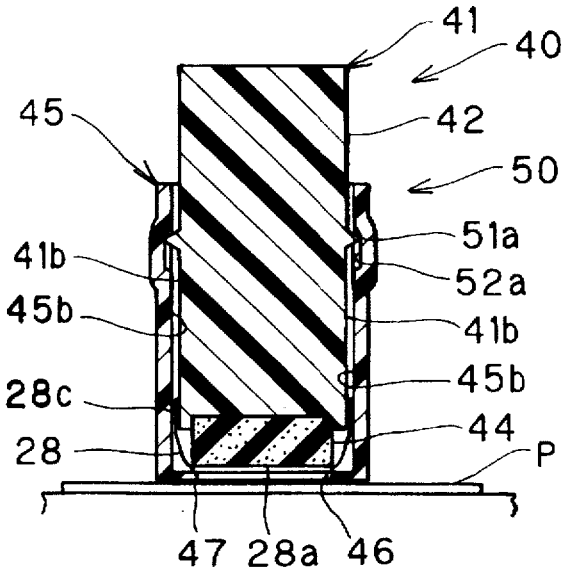
FIG. 9 is a cross-sectional view showing the assembled stamp device of the first embodiment before printing.
Figure 10:
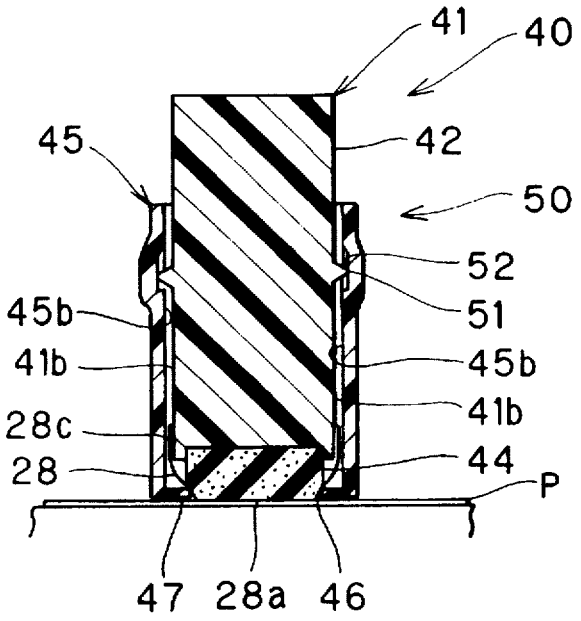
FIG. 10 is a cross-sectional view showing the assembled stamp device of the first embodiment in a printing condition.

As can best be seen in FIG. 9, an engagement mechanism 50 is provided to the stamp body 41 and the skirt member 45 and includes the pair of engaging portions 51, formed in the lengthwise sides 41*a* of the stamp wall 41, and the pair of engaged portions 52, formed in the internal surface 45*b* of the skirt member 45. The engagement mechanism 50 supports the skirt member 45 in the stamp body 41 so it is capable of vertical movement with a small stroke between the first position, wherein the print portion 28*a* protrudes downward from the open portion 46 as shown in FIG. 10, and the second position, wherein the print portion 28*a* is retracted within the opening portion 46 as shown in FIG. 9.

Figure 6:
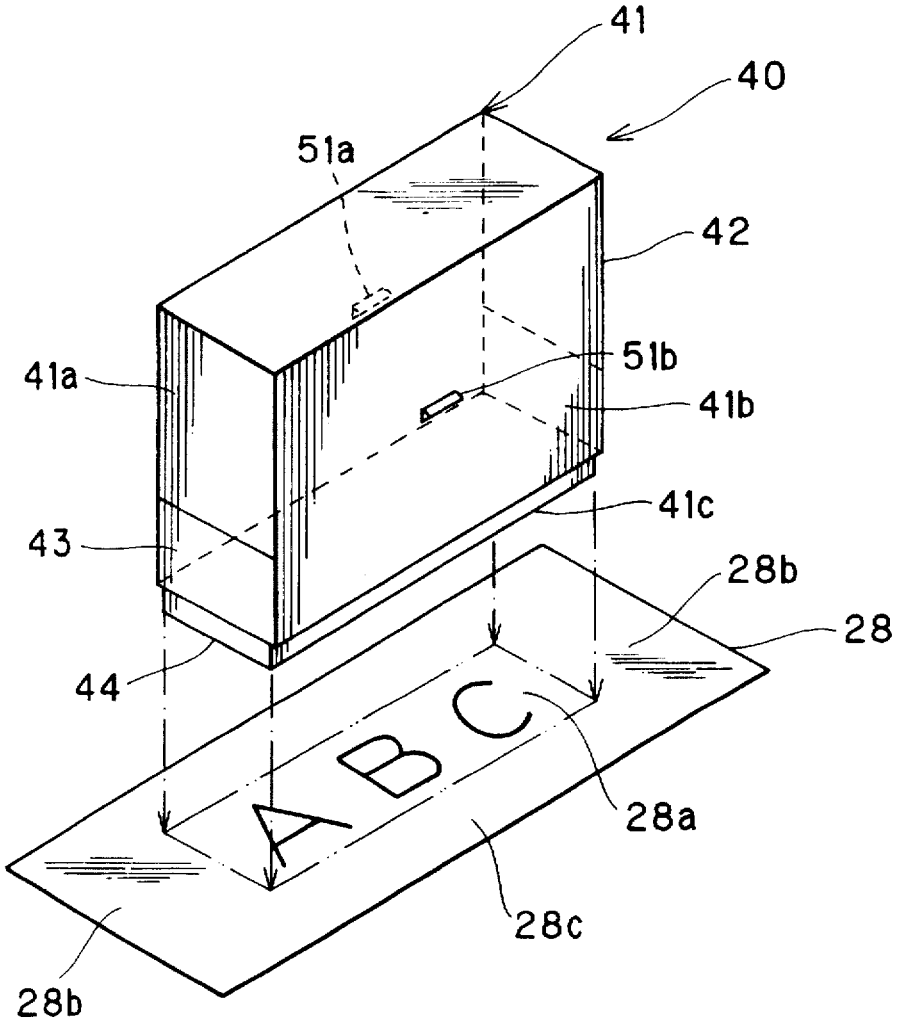
FIG. 6 is a perspective view partially in phantom showing assembly of a stamp portion and the stencil sheet of a stamp device according to a first embodiment of the present invention.
Figure 7:
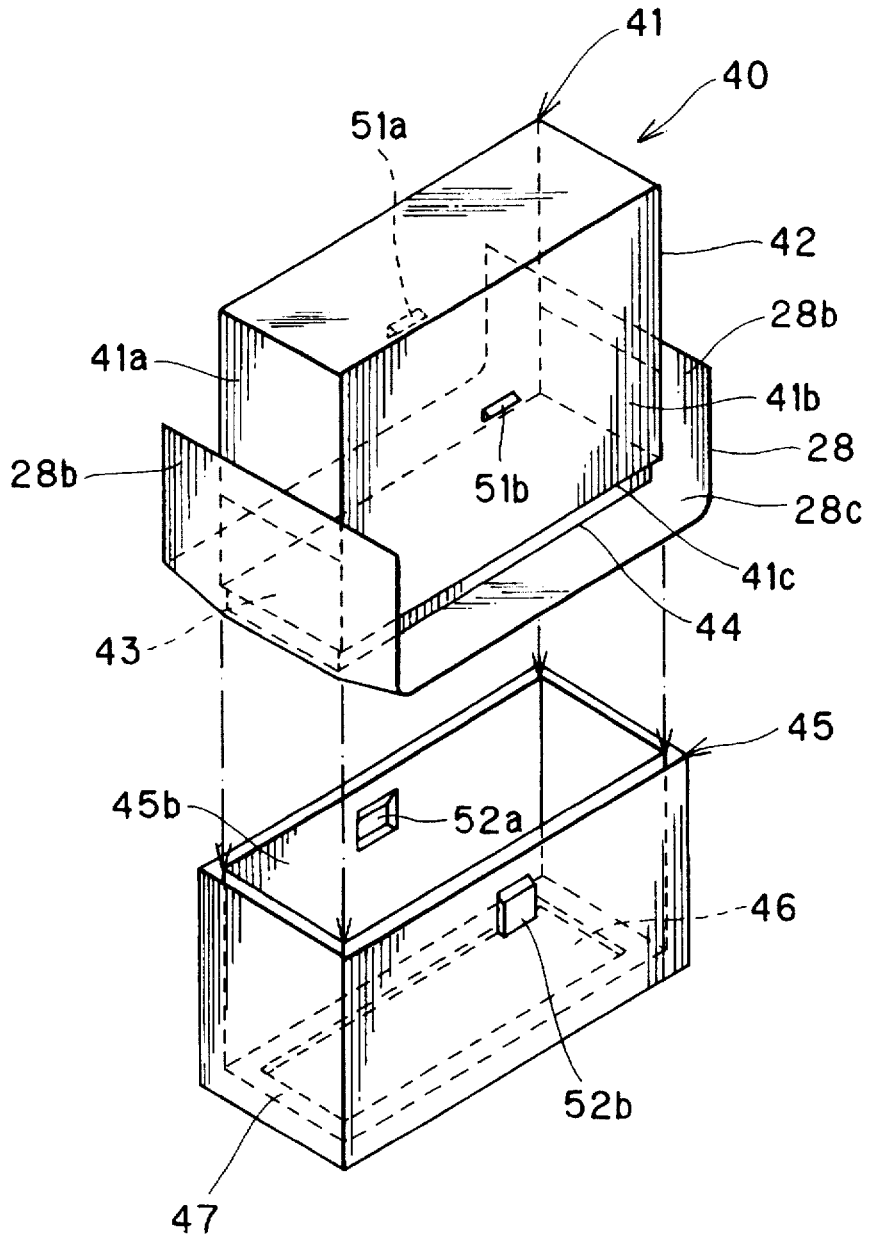
FIG. 7 is a perspective view partially in phantom showing assembly of the stamp portion, the stencil sheet, and a skirt member of the stamp device according to the first embodiment.

Next, the method of mounting the stencil sheet 28 to the stamp body 41 and operation of the stamp unit 40 to print a stencil image will be explained. First, the stencil sheet 28 is formed with a desired stencil image using the thermal perforation unit 1 shown in FIG. 1 and then cut to a predetermined length. Then, as shown in FIG. 6, the stencil sheet, 28 formed with a stencil image thereon, is oriented with the porous support member 37 facing upward and the stamp body 41 is positioned thereabove with the ink impregnated body 44 aligned over the print portion 28*a*. The stamp body 41 is lowered on the top of the porous support member 37 from above so that, as shown in FIG. 7, the stencil sheet 28 is brought into intimate contact with the lower surface of the ink impregnated body 44. Then the lengthwise edge portions 28*b* of the stencil sheet 28 are folded up and adhered to both lengthwise sides 41*a* of the stamp body 41 by the adhesive 43.

Figure 8:
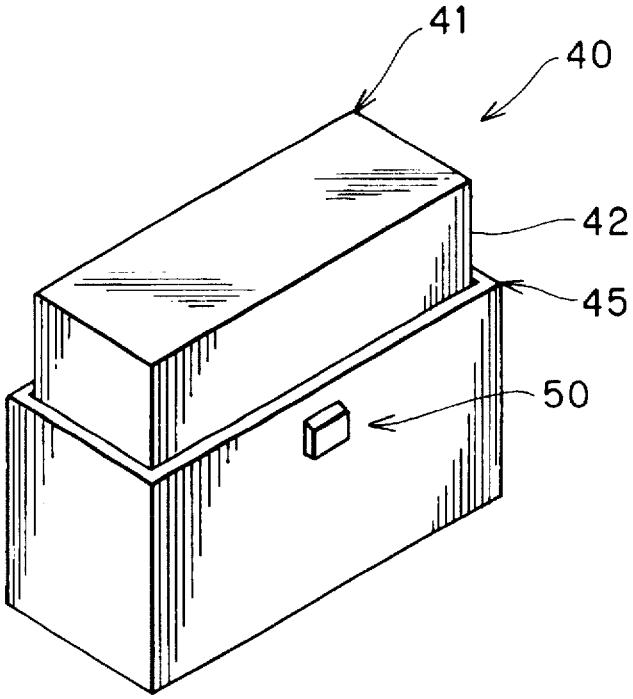
FIG. 8 is a perspective view partially in phantom showing the assembled stamp device according to the first embodiment.

Next, the stamp body 41 is lowered and, as shown in FIG. 8, fitted into the skirt member 45. As a result, as shown in FIG. 9, the engaging portions 51 of the stamp body 41 will engage with the engaged portions 52 of the skirt member 45 and the widthwise edge portions 28*c* of the stencil sheet 28 will be sandwiched between the stamp body 41 and the skirt member 45 so that the widthwise edge portions 28*c* of the stencil sheet 28 are raised along the widthwise sides 41*b* of the stamp body 41.

When a user wishes to stamp a stencil image using the stamp unit 40, as shown in FIG. 9 he or she places the stamp unit 40 on a sheet P or other medium to be printed on. While the stamp unit 40 is in this condition, that is, before the stamp body 41 is pressed down, the outer peripheral portion of the ink impregnated body 44 is supported by the support lip 47 of the skirt member 45 via the stencil sheet 28. Also, the print portion 28*a* of the stencil sheet 28 is positioned at the opening portion 46 above the lower edge of the support lip 47. Therefore, the user can easily place the skirt member 45 with the opening portion 46 oriented downward on the sheet P to position the stamp unit 40 to a predetermined print position on the sheet P without printing a stencil image. Next, the user presses down the stamp body 41 so that, as shown in FIG. 10, the stamp body 41 lowers in a small stroke developed by sliding movement between the engaging portions 51 and the engaged portions 52. The print portion 28*a* will move to the lower edge of the opening portion 47 while the ink impregnated body 44 is resiliently deformed. The print portion 28*a* of the stencil sheet 28 is pressed against the sheet P so that ink oozes through the perforations to print a stencil image on the sheet P.

Afterward, the stamp body 41 is lifted up or, said differently, the skirt member 45 is pressed downward with respect to the stamp body 41. Upon doing so, the stamp body 41 is raised upward by resiliency of the ink impregnated body 44 and in the small stroke with respect to the skirt member 45 by frictional sliding movement between the engaging portions 51 and engaged portions 52. The ink impregnated body 44 will revert to its original shape and the print portion 28*a* of the stencil sheet 28 will be supported retracted back into the opening portion 46. It should be noted that the stamp unit 40 can be provided with a resilient body for urging the skirt member 45 downward with respect to the stamp body 41 or, said differently, for urging the stamp body 41 upward with respect to the skirt member 45.

With the above-described configuration, the lengthwise edge portions 28*b* of the thermal sheet 28 are adhered to corresponding ones of the both lengthwise sides 41*a* of the stamp body 41 by the adhesive 43. Also, the widthwise edge portions 28*c* of the stencil sheet 28 are raised along corresponding widthwise sides 41*b* of the stamp body 41. Further, the stencil sheet 28 covers the lower and outer peripheral surface portions of the ink impregnated body 44. This configuration prevents ink from leaking out of the ink impregnated body 44. Also, because the opening portion 46 is formed in the lower surface portion of the skirt member 45, when the skirt member 45 is fitted to the stamp body 41 so that the skirt member 45 brings the lengthwise edge portions 28*b* and the widthwise edge portion 28*c* of the stencil sheet 28 into intimate contact with corresponding sides 41*a*, 41*b* of the stamp body 41, by pressing the stencil sheet 28 and the ink impregnated body 44 against the sheet P, a stencil image can be printed without the stencil sheet 28 peeling away from the lower surface of the ink impregnated body 44.

The widthwise edge portions 28*c* of the stencil sheet 28 can also be adhered to the lengthwise sides 41*a* of the stamp body 41. In this case, when the skirt member 45 is fitted from below to the lower portion of the stamp body 41, the widthwise edge portions 28*c* of the stencil sheet 28 will be raised up along both widthwise sides 41*b* of the stamp body 41 so that the skirt member 45 brings both the lengthwise edge portions 28*b* and widthwise edge portions 28*c* of the stencil sheet 28 into intimate contact with corresponding sides 41*a*, 41*b* of the stamp body 41. In this way, the stencil sheet 28 can be easily and reliably brought into intimate contact with the ink impregnated body 44.

The engagement mechanism 50 allows the skirt member 45 to be supported, with respect to the stamp body 44, movable in the vertical direction with a small stroke between a first position, wherein the print portion 28*a* protrudes from beneath through the opening portion 46, and a second position, wherein the print portion 28*a* is retracted within the opening portion 46. Therefore, during printing, the print portion 28*a* can be pushed through the opening portion 46 so that a stencil image is printed by pressing the print portion 28*a* and the ink impregnated body 44 against the sheet P. On the other hand, when the stamp unit 40 is not in use, it can be stored with the skirt member 45 lowered so that the print portion 28*a* is retracted within the opening portion 46, thereby effectively preventing ink from the print portion 28*a* from staining other objects.

Because the engagement mechanism includes a first pair of engaging portions 51 formed in the parallel pair of sides 41*b* of the stamp body 41 and a pair of engaged portions 52 formed, engagable with the engaging portion 51, in the parallel pair of inner wall surfaces 45*b* of the skirt member 45, the engagement mechanism 50 can be formed with a simple configuration.

Figure 11:
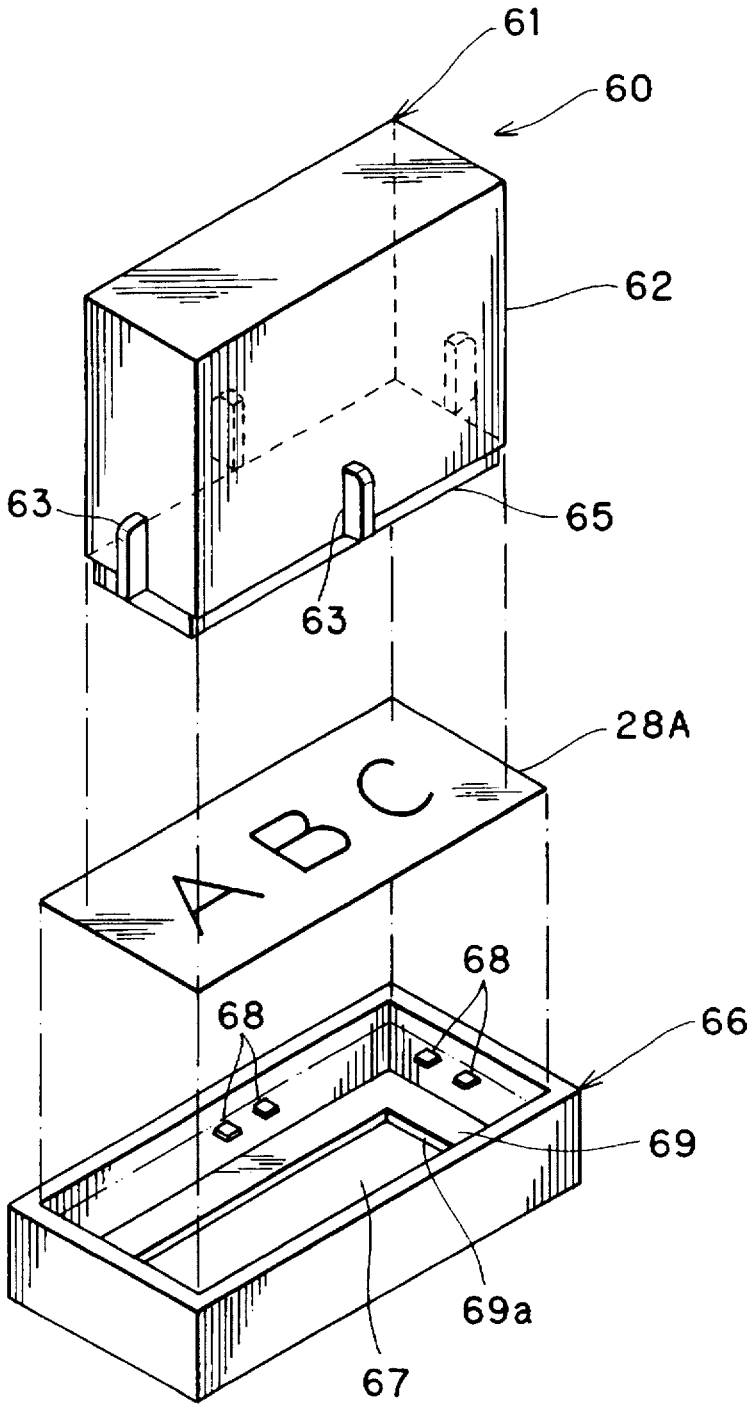
FIG. 11 is a perspective view partially in phantom showing assembly of a stamp portion, a stencil sheet, and a skirt member of a stamp device according to a second embodiment of the present invention.
Figure 12:
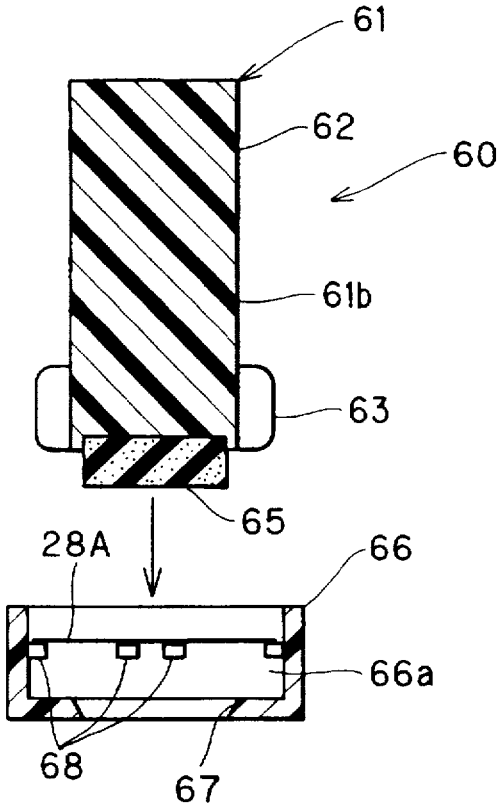
FIG. 12 is a cross-sectional view showing assembly of the stamp device according to the second embodiment.
Figure 13:
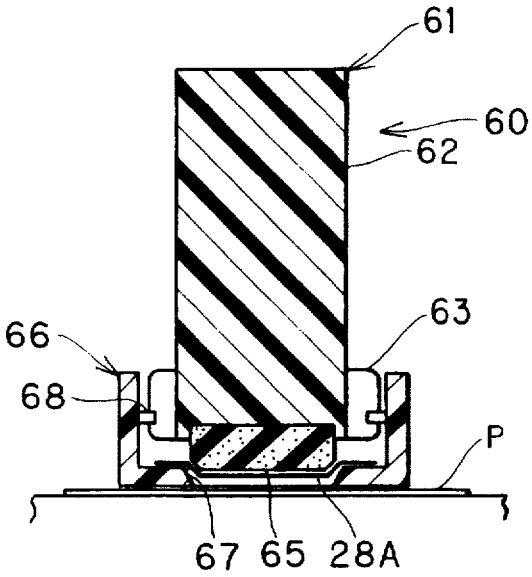
FIG. 13 is a cross-sectional view showing the assembled stamp device of the second embodiment before printing.

Next, a stamp unit 60 according to the second embodiment of the present invention will be described while referring to FIGS. 11 to 13. The stamp unit 60 includes a parallelepiped-shaped stamp body 61 having a grip portion 62; a parallelepiped ink impregnated body 65 having a base surface portion smaller than the stamp body 61 and attached to the lower portion of the stamp body 61; a skirt member 66 freely detachably fitted to the stamp body 61; and a stencil sheet 28A formed with a stencil image.

The stamp body 61 has formed to the lower central portion of each side, an elongated guide portion 63 disposed with an upright posture. A lip portion 69 is provided to the lower surface portion of the skirt member 66. The lip portion 69 has an inner peripheral surface 69a tapering inward so that an opening portion 67 defined thereby is larger at its interior side that at its exterior side. However, the lower edge portion of the lip portion 69 is formed smaller than the lower surface of the ink impregnated body 65. Pairs of support portions 68 for supporting the stencil sheet 28A and guiding the guide portions 63 of the stamp body 61 are integrally formed to each inner wall surface of the skirt member 66.

Next, a method for mounting the stencil sheet 28 to the stamp body 61 will be explained. As shown in FIG. 12, first, the stencil sheet 28A formed with a stencil image is supported by the four pairs of support portions 68 of the skirt member 66. Next, as the stamp body 61 is fitted in the skirt member 66, the stencil sheet 28A is lowered with the ink impregnated body 65 to the base portion of the skirt member 66. The stamp body 61 is then lowered further while the guide portions 63 are guided by the support portions 68. As shown in FIG. 13, the front edge of the ink impregnated body 65 resiliently deforms and the stencil sheet 28A is fitted in the opening portion 67 so that the stencil sheet 28A is brought into intimate contact with the lower surface and outer peripheral surface of the ink impregnated body 65.

Figure 14:
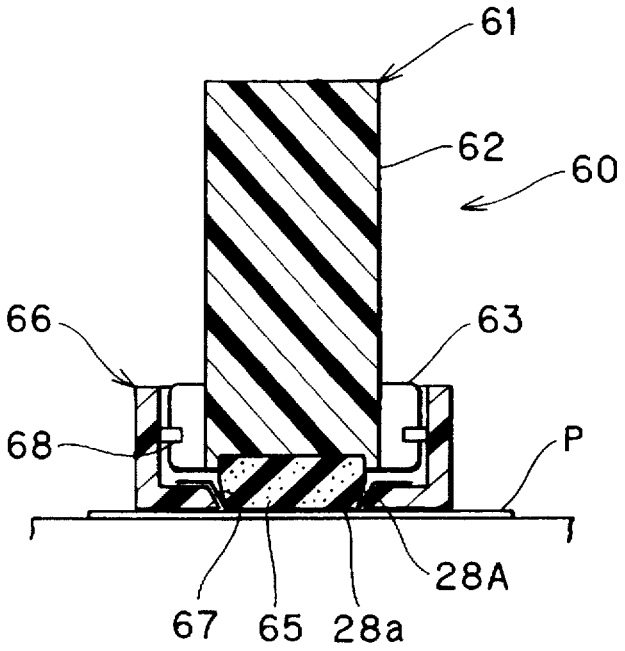
FIG. 14 is a cross-sectional view showing the assembled stamp device of the second embodiment in a printing condition.

In the same manner as in the first embodiment, when a stencil image is to be printed, the stamp unit 60 is positioned at a predetermined position on the sheet P. From this condition, the stamp body 61 pressed downward as shown in FIG. 14, so that the ink impregnated body 65 is resiliently deformed. The print portion 28*a* of the stencil sheet 28A is pushed downward out from the opening portion 67 so that the print portion 28*a* and the ink impregnated body 65 are pressed against the sheet P to print a stencil image.

In the same manner as in the first embodiment, the stamp unit 60 can be used to print a stencil image without ink leaking from the ink impregnated body 65, without the stencil sheet 28 peeling away from the lower surface of the ink impregnated body 65, and with the stencil sheet 28 easily and reliably maintained in the intimate contact with the ink impregnated body 65.

It should be noted that stencil images can be printed by removing the stamp body 61 from the skirt member 66 and pressing the ink impregnated body 65 and the stencil sheet 28 against the sheet P. In this case, the skirt member 66 can be used as a stand for the stamp body 61.

Figure 15:
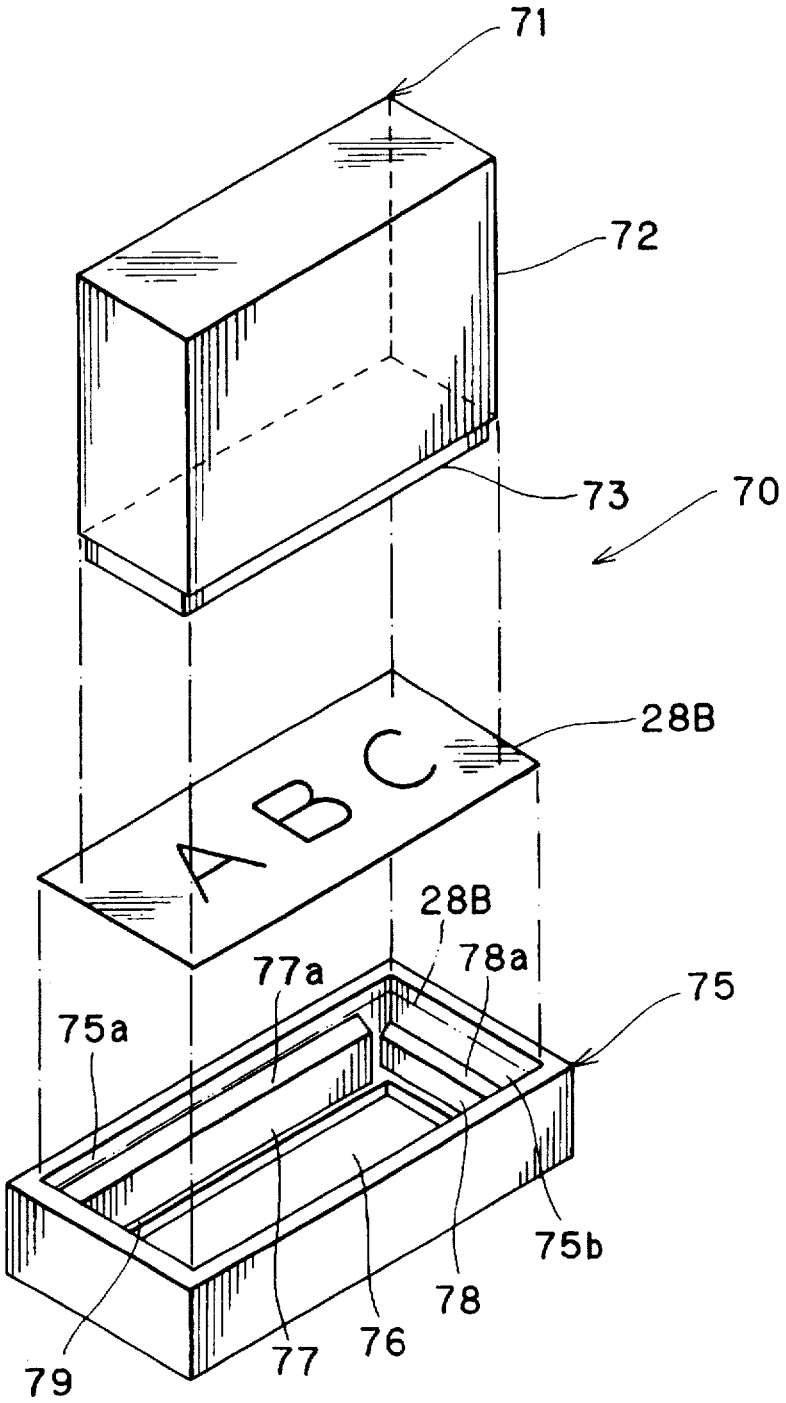
FIG. 15 is a perspective view partially in phantom showing assembly of a stamp portion, a stencil sheet, and a skirt member of a stamp device according to a third embodiment of the present invention.
Figure 16:
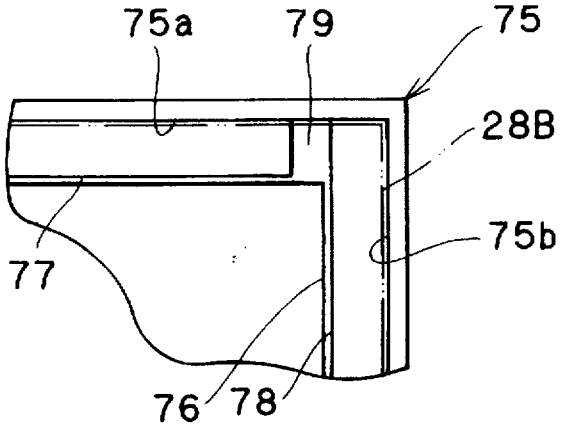
FIG. 16 is a magnified plan view showing a corner portion of the skirt member.
Figure 17:
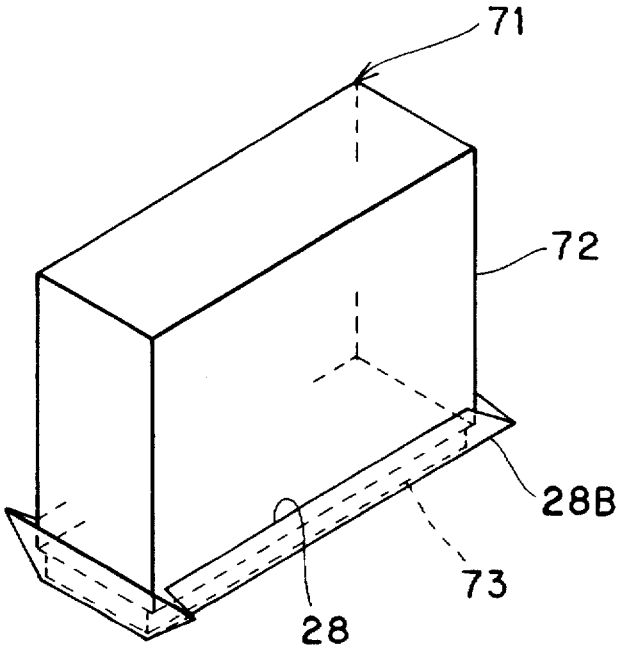
FIG. 17 is a perspective view showing a the stamp device according to a third embodiment prepared for printing stencil images.

Next, a stamp unit 70 according to a third embodiment of the preferred invention will be described while referring to FIGS. 15 to 17. The stamp unit 70 includes a parallelepiped-shaped stamp body 71 having a grip portion 72; an ink impregnated body 73 attached to the lower portion of the stamp body 61; a stencil sheet 28B formed with a stencil image; and a skirt member 75 freely detachably fitted to the stamp body 71.

The skirt member 75 includes an inwardly extending lip portion 79 defining an opening portion 76 at its lower surface. A first guide portion 77 is provided to a pair of inner wall surfaces 75*a* opposing each other in the skirt member 75. The first guide portions 77 each have a slanting guide surface 77*a* at a first height above the opening portion 76. The slanting guide surfaces 77*a* slant downward so as to protrude from the inner side from the inner wall surface 75*a* toward the inner peripheral edge of the lip portion 79. A second guide portion 78 is provided to the other pair of opposing inner wall surfaces 75*b*. The second guide portions 78 each have a slanting guide surface 78*a* at an inner side from the inner wall surface 75*b*. The slanting guide surfaces 78*a* slant inward and downward from a second height, which is lower than the first height, toward the peripheral edge of the lip portion 79. As shown in FIG. 16, an escape portion 79 is formed to each of four internal corners of the skirt member 75 between the first guide portions 77 and the second guide portions 78. The escape portions 79 provide a space for the corner portions of the stencil sheet 28 to enter when the stencil sheet 28 is folded and guided by the first and second guide portions 77, 78.

Next, operations for mounting the stencil sheet 28B to the stamp body 71 will be described. First, the skirt member 75 is fitted to the outer periphery of the stamp body 71 from below while the sheet-shaped stencil sheet 28B clings by viscosity of the ink to the lower surface of the ink impregnated body 73. Then, the slanting guide surfaces 77*a* of the pair of first guide portions 77 guide corresponding the widthwise edge portions of the stencil sheet 28B into intimate contact with corresponding sides of the stamp body 71. Next, the slanting guide surfaces 78*a* of the pair of second guide portions 78 guide both parallel lengthwise portions of the stencil sheet 28 into intimate contact with corresponding sides of the stamp body 71. The edges of the stencil sheet 28 are held in place sandwiched between the surfaces of the first guide portions 77 and the second guide portions 78 and the side surfaces of the stamp body 71.

When a stencil image is to be printed with the skirt member 75 still fitted to the stamp body 71, the stamp body 71 is pressed downward. Deformation of the ink impregnated body 73 causes the print portion of the stencil sheet 28B to protrude from the lower edge of the opening portion 76. A stencil image is then printed by pressing the ink impregnated body 73 and the stencil sheet 28 against the sheet P. It should be noted that, as shown in FIG. 17, the stamp body 71 can be removed from the skirt member 75 and a stencil image printed by pressing the ink impregnated body 73 and the stencil sheet 28 against the sheet P. In this case, the skirt member 75 can be used as a stand for the stamp body 71. According to the stamp unit 70, ink can be prevented from leaking out of the ink impregnated body 73 and the stencil sheet 28 can be easily and reliably maintained in intimate contact with the ink impregnated body 73.

Next, an explanation will be provided for a stamp device 140 according to a fourth embodiment of the present invention.

Figure 18:
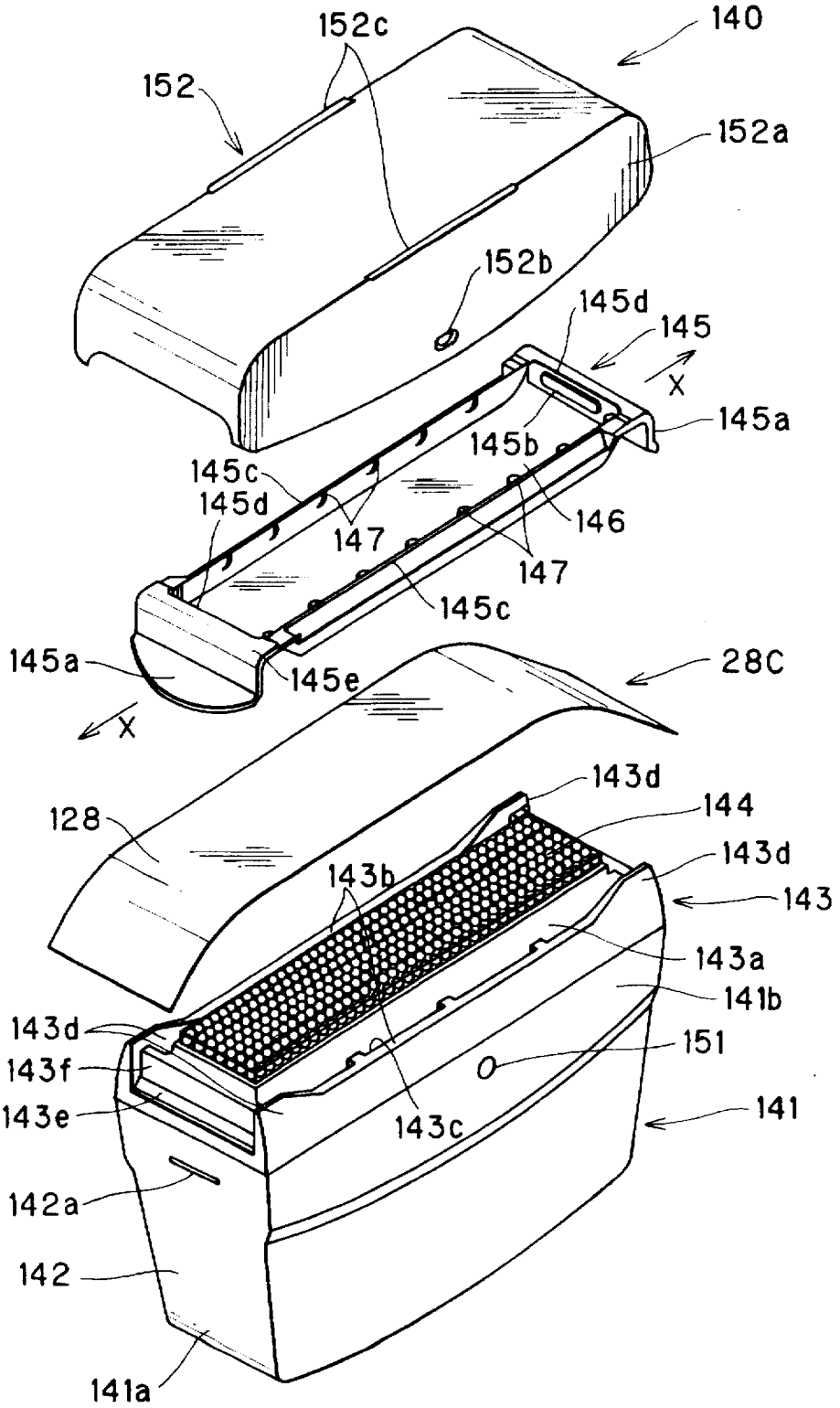
FIG. 18 is an exploded perspective view showing a stamp device according to a third embodiment of the present invention.
Figure 19A:
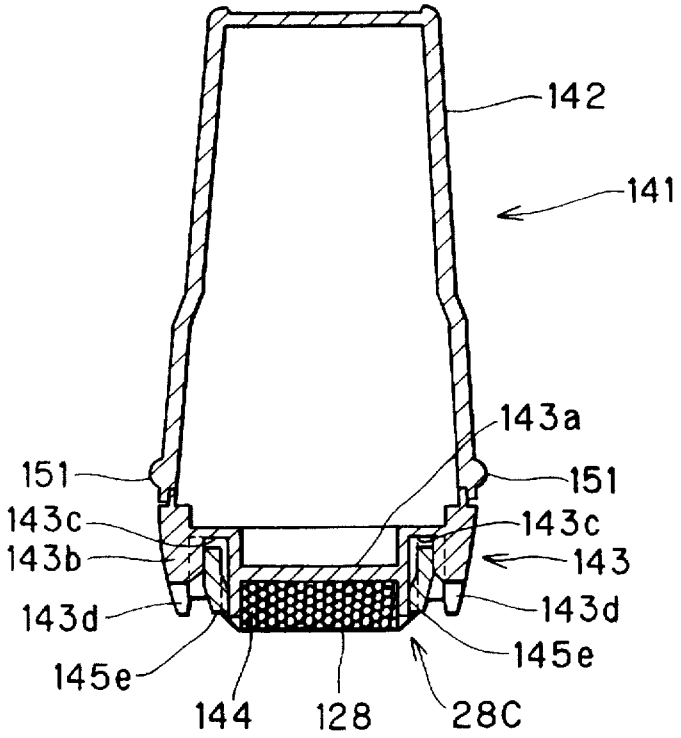
FIG. 19(*a*) is a cross-sectional view showing the stamp device of FIG. 18 without a cap mounted thereto.

As shown in FIGS. 18 and 19, the stamp device 140 includes a stamp body 141, an ink impregnated body 144, and a print surface fixing frame 145 serving as a skirt member. It should be noted that the stamp device 140 is shown upside down in FIG. 18 to facilitate understanding. The stamp body 141 is formed from a compound resin material into a substantially rectangular shape. The ink impregnated body 144, which is impregnated with ink, is formed from a porous compound resin into a substantially rectangular shape smaller than the rectangular shape of the stamp body 141. The ink impregnated body 144 is attached to the base portion of the stamp body 141. The stencil sheet 28C is formed with a stencil image and formed to a size having a length and a width greater than those of the base portion of the ink impregnated body 144. The print surface fixing frame 145 is freely detachably fitted to the stamp body 141.

The stamp body 141 is formed with a grip portion 142 for the user to grasp by hand. The grip portion 142 is formed at the upper portion of the stamp body 141, that is, at the opposite end of the stamp body 141 with respect to the ink impregnated body 144. As shown at the lower portion of FIG. 18, positioning marks 142*a* are formed to the lengthwise side surfaces 141*a* of the stamp body 141. The positioning marks 142*a* are for aligning the lengthwise edges of the stencil sheet 28C, formed with a stencil image therein, in order to mount the stencil sheet 28C at its proper position with respect to the ink impregnated body 144. Semi-spherical engagement portions 151 are formed at the approximate center of both widthwise side surfaces 141*b* of the stamp body 141.

As shown in FIGS. 18 and 19(*a*), the ink impregnated body 144 is supported in connection with the grip portion 142 by the support portion 143. The surface of the ink impregnated body 144 that does not contact the stencil sheet 28C is sealingly fixed in an ink impregnated body support portion 143*a* of the support portion 143. A groove portion 143*c* in which is fitted the print surface fixing frame 145 is formed between the impregnated body support portion 143*a* and both widthwise sides surfaces 143*b* of the support portion 143. Guide portions 143*d* for positioning the stencil sheet 28C in its widthwise direction are formed to protrude from both widthwise side surfaces of the support portion 143. Said differently, the guide portions 143*d* protrude from the four corners of the support portion 143 compared with the center portions of the side surfaces 143*b*. Confronting guide portions 143*d* sandwiching therebetween the ink impregnated body 144 are separated by a distance substantially equal to the width of the stencil sheet 28C.

Further, a groove 143*e* for engaging the print surface fixing frame 145 is formed to both lengthwise sides surfaces of the support portion 143.

The print surface fixing frame 145 has formed, to its lower surface portion, an opening portion 146 exposing the print surface portion 128*a* of the stencil sheet 28C, which corresponds to the lower surface of the ink impregnated body 144. The opening portion 146 is formed in a substantially rectangular shape slightly smaller in length and width than the lower surface of the ink impregnated body 144. Support portions 147 for supporting the outer periphery of the ink impregnated body 144 through the stencil sheet 28C are formed to the inner periphery in the lengthwise direction of the print surface fixing frame 145.

Also, resilient and downward depending engaging portions 145*a* are provided at both lengthwise edges of the printing surface fixing frame 145 as shown in FIG. 18.

Protrusion portions 145b for engaging with grooves 143e provided to the support portion 143 are formed to the inner lengthwise surfaces of the engaging portion 145a.

Next, an explanation will be provided for a method of mounting the stencil sheet 28C to the stamp body 141 and for operating the stamp device 140 to print a stencil image.

First, a desired stencil image is formed in the stencil sheet 28C using the thermal perforation unit 1 shown in FIG. 1 and the stencil sheet 28C is cut to a predetermined length. When the stencil sheet 28C formed in this manner is to be mounted to the stamp body 141, as shown in FIG. 18 the stencil sheet 28C formed with a stencil image is arranged so that the porus support body 37 is in opposition with the ink impregnated body 144. Then, one lengthwise edge of the stencil sheet 28C is aligned with a corresponding one of the positioning marks 142a of the stamp body 141 and temporarily held in place by hand. Then, the stencil sheet 28C is mounted to the upper surface of the ink impregnated body 144 as guided by the guide portions 143d. When the other lengthwise edge of the stencil sheet 28C is aligned with the other positioning mark 142a, it is also held in place by hand. At this time, because the widthwise edges of the stencil sheet 28C are held between the guide portions 143d, the stencil sheet 28C will not shift out of position during operation. Also, both lengthwise edges of the stencil sheet 28C can be easily aligned using the positioning marks 142a.

It should be noted that the stencil sheet 28C is cut to a length wherein it will be held against the upper surface of the ink impregnated body 144 by an appropriate tension when the lengthwise edges of the stencil sheet 28C are aligned with corresponding positioning marks 142a.

When the print surface fixing frame 145 is lightly pressed toward the stencil sheet 28C so that the engaging portions 145a move downward, then both widthwise side walls 145c of the print surface fixing frame 145 fit into corresponding groove portions 143c of the support portion 143 and both widthwise edge portions of the stencil sheet 128 become sandwiched between the support portions 147, which are provided to the inner surface of the side walls 145c, and the outward side surface of the ink impregnated body support portion 143a of the support portion 143. Simultaneously with this, by being pressed from above the resilient engaging portions 145a, which are provided with appropriate resilience, bend slightly outward in directions indicated by arrows X in FIG. 18 and the protrusion portions 145b formed to the inner surfaces of the engaging portion 145a are brought into abutment pressing with the side surfaces 143f of the support portion 143 through the stencil sheet 28C. When the print surface fixing frame 145 is further pressed downward, the protrusion portions 145b engage in the grooves 143e of the support portion 143 through the stencil sheet 28C. When the bending of the engaging portion 145a is released, the print surface fixing frame 145 becomes completely mounted to the stamp body 141. In this condition, the lengthwise edges of the stencil sheet 28C are sandwiched between the grooves 143e and the protrusions 145b and between the side surfaces 143f of the support portion 143 and the inner surfaces 145d of the engaging portion 145. The guide portions 143d and the engaging portions 145a are formed so that the tips of the guide portions 143d will be flush with and on the same plane as surfaces 145e adjacent to the guide portions 143d when the print surface fixing frame 145 is mounted to the support portion 143. On the other hand, the print surface portion 128 will protrude from away this plane.

By mounting the print surface fixing frame 145 to the support portion 143, the peripheral edge of the stencil sheet 28C is fixed in place. Both the lengthwise and widthwise edge portions of the stencil sheet 28C are fixed in a condition drawn toward the grip portion 142 away from the exposure portion of the ink impregnated body 144. Therefore, the exposed portion of the ink impregnated body 144, that is, the surface and peripheral edge of the ink impregnated body 144 are completely covered by the stencil sheet 28C so that there is no fear of ink leaking from the ink impregnated body 144 and out of the stamp device 140.

When printing a stencil image using the stamp device 140 configured as described above, because the print surface 128 protrudes from the edge portion of the support portion 143, a stencil image can be printed on the sheet P by pressing the grip portion 142 against the sheet P with an appropriate pressure.

Figure 19B:
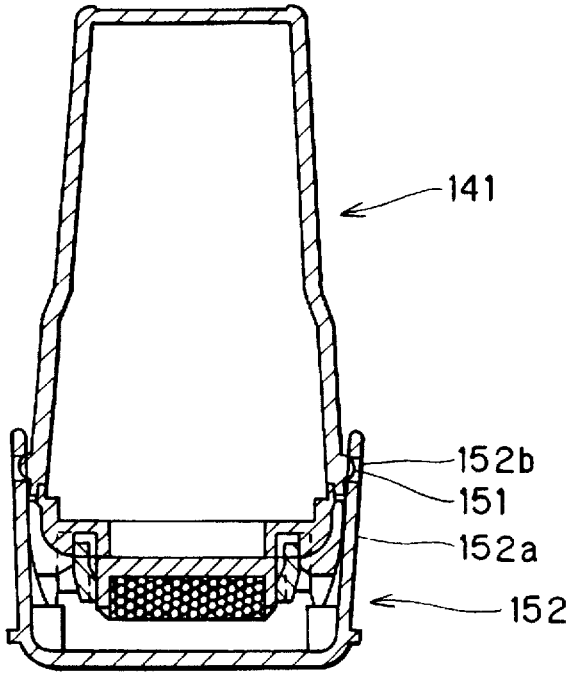

It should be noted that a cover portion 152 for covering the print surface portion 128 of the stencil sheet 28C is provided to the stamp device 140. An engaging hole 152b is provided to the widthwise side surface 152a of the cover portion 152 at a position corresponding to the engaging portion 151 provided to the stamp body 141. By engaging the engaging portion 151 in the engaging hole 152b, the cover portion 152 can be prevented from falling off the stamp device 140. When the stamp device is not in use, by mounting the cover portion 152 onto the stamp body 141, the print surface can be prevented from drying out. Further, as shown in FIG. 19(b), when the cover portion 125 is mounted to the stamp device 140, the print surface portion 128 is not in contact with the inner surface of the cover portion 125. Therefore, the stamp body 141 can be stored in an upright posture with the cover portion 125 serving as a base. The print surface will not be damaged even when stored facing downward in this manner. Further, ribs 125c are provided following the lower edges of the widthwise side surfaces 152a of the cover portion 152. A user pinches these between his or her fingers to bend the sides surfaces 152a outward so that the cover portion 152 can be easily detached.

When the stencil sheet 28C is to be replaced, the user orientates the stamp device 140 as shown in FIG. 18 and presses his or her finger against the bent portion of both engaging portions 145a of the print surface fixing frame 145. Then the user presses the engaging portions 145a slightly upward while bending them outward. This releases the engagement between the protruding portions 145b and the grooves 143e so that the print surface fixing frame 145 can be easily detached.

According to the stamp device 140 of the forth embodiment, by mounting the print surface fixing frame 145 to the support portion 143 of the stamp body 141, the peripheral edge of the stencil sheet 28C is fixed in place. The lengthwise and widthwise edge portions of the stencil sheet 28C are fixed in place slightly drawn toward the grip portion 142 away from the exposure portion of the ink impregnated body 144. Therefore, the lower surface and outer peripheral surface of the ink impregnated body 144, which protrude from the support portion 143, are completely covered by the stencil sheet 28C so that ink from the ink impregnated body 144 will not leak out of the stamp device 140. Also, because the opening portion 146 is formed in the base of the print surface fixing frame 145, when the print surface fixing frame 145 is fitted to the stamp body 141, that is, when the widthwise and lengthwise edges of the stencil sheet 28C are held in intimate contact with the support portion 143 of the stamp body 141 by the print surface fixing frame 145, the stencil image can be printed by pressing the stencil sheet 28C and the ink impregnated body 144 against the sheet P.

Therefore, the stencil sheet 28C can be reliably prevented from peeling away from the lower surface of the ink impregnated body 144.

By positioning the lengthwise edges of the stencil sheet 28C using the positioning marks 142a formed in the side surfaces 141*a* of the stamp body 141 and further by guiding the widthwise edge portions by the guide portions 143*d*, the stencil sheet 28C can be easily positioned with respect to the stamp body 141. By mounting the print surface fixing frame 145 to the stamp body 141 in this condition, the stencil sheet 28C can be easily and reliably held in intimate contact with the ink impregnated body 144.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A stamp device for printing a stencil image by pressing the stamp device against a medium to be printed on, the stamp device comprising:

a stamp body including a base portion at a lower end thereof, wherein the stamp body is substantially rectangular in shape and has two parallel lengthwise side surfaces and two parallel widthwise side surfaces;

an ink impregnated body impregnated with ink and attached to the base portion of the stamp body;

a thermal stencil sheet disposed on the stamp body so as to cover the ink impregnated body;

a skirt member fitted around the lower end of the stamp body, the stamp body being freely movable with respect to the skirt member during printing;

an adhesive layer provided to the lengthwise side surfaces of the stamp body and for adhering the stencil sheet to the lengthwise side surfaces of the stamp body;

an engaging portion provided to one of the stamp body and the skirt member; and an engaged portion provided to the other of the stamp body and the skirt member and for engaging with the engaging portion.

2. A stamp device as claimed in claim 1, wherein:

the skirt member is formed with an opening exposing a print portion of the stencil paper corresponding to the ink impregnated body; and the engaging portion and the engaged portion support the skirt body with respect to the stamp body movable between a first position wherein the print portion protrudes through the opening and a second position wherein the print portion is retracted within the opening.

3. A stamp device as claimed in claim 2, wherein:

the engaged portion includes a member formed to the stamp body so as to protrude outwardly toward the skirt member; and the engaging portion is formed from an indentation formed in an internal side wall of the skirt member at a position corresponding to the engaged portion.

4. A stamp device as claimed in claim 2, wherein the ink impregnated body is formed from a resilient material and has an outer periphery larger than the opening of the skirt member, the resiliency of the ink impregnated body urging the skirt body into the second position.

5. A stamp device as claimed in claim 2, further comprising an urging means for urging the skirt body into the second position.

6. The stamp device as claimed in claim 5, wherein the urging means comprises a resilient body located on the stamp body.

7. The stamp device as claimed in claim 5, herein the urging means comprises a resilient body located on the skirt member.

8. A stamp device for printing a stencil image by pressing the stamp device against a medium to be printed on, the stamp device comprising:

a stamp body including a grip portion at an upper end thereof and a base portion at a lower end thereof;

an ink impregnated body impregnated with ink and attached to the base portion of the stamp body;

a thermal stencil sheet disposed on the stamp body so as to cover the ink impregnated body;

a skirt member fitted around the lower end of the stamp body;

a support portion provided to one of the stamp body and the skirt member; and a guide member provided to the other of the stamp body and the skirt member and cooperating with the support portion to guide and support the stamp body with respect to the skirt member, the stamp body being freely movable with respect to the skirt member during printing.

9. A stamp device as claimed in claim 8, wherein:

the support portion includes an outwardly protruding plate shaped member formed to the stamp body; and the guide member includes a pair of inwardly protruding protrusions with a gap therebetween into which the plate shaped member is fitted.

10. A stamp device as claimed in claim 8, wherein the impregnated body has a peripheral edge;

wherein the skirt member has an upper peripheral edge and a lower peripheral edge; and wherein the skirt member includes an inward tapered opening portion at a distance from the grip, the upper peripheral edge of the skirt member being larger than the peripheral edge of the ink impregnated body, the lower peripheral edge of the skirt member being smaller than the peripheral edge of the ink impregnated body, the opening portion exposing a print portion of the stencil paper corresponding to the ink impregnated body.

11. A stamp device for printing a stencil image by pressing the stamp device against a medium to be printed on, the stamp device comprising:

a stamp body including a base portion at a lower end thereof;

an ink impregnated body impregnated with ink and attached to the base portion of the stamp body;

a thermal stencil sheet disposed on the stamp body so as to cover the ink impregnated body;

a skirt member fitted around the lower end of the stamp body;

a first slanting guide surface provided to the skirt member at a first surface thereof confronting the stamp body and for guiding the stencil sheet into intimate contact with the stamp body; and a first slanting guide portion provided to the skirt member at the first surface thereof and for holding the stencil plate in place sandwiched between itself and the stamp body.

12. A stamp device as claimed in claim 11, further comprising:

a second slanting guide surface provided to the skirt member at a second surface thereof substantially at right angles to the first surface, the second slanting guide surface being for guiding the stencil sheet into intimate contact with the stamp body; and a second slanting guide portion provided to the second surface and for holding the stencil plate in place sandwiched between itself and the stamp body, a space into which a corner portion of the stencil sheet fits being formed between the first slanting guide portion and the second slanting guide portion.

13. A stamp device as claimed in claim 12, further comprising an inwardly extending lip portion formed to the skirt member and defining an opening exposing a print portion of the stencil sheet corresponding to the ink impregnated body, the lip portion extending further inward than the first and second slanting guide portions.

14. A stamp device for printing a stencil image by pressing the stamp device against a medium to be printed on, the stamp device comprising:

a stamp body including a base portion at a lower end thereof;

an ink impregnated body impregnated with ink and attached to the base portion of the stamp body;

a thermal stencil sheet disposed on the stamp body so as to cover the ink impregnated body;

a skirt member fitted around the lower end of the stamp body;

a groove formed in a lengthwise side of the stamp body; and a protrusion formed on a first surface of a lengthwise side wall of the skirt member at a position corresponding to the groove and for engaging in the groove, said groove and said protrusion forming a mechanism for maintaining intimate contact between the thermal stencil sheet and the stamp body.

15. A stamp device as claimed in claim 14, further comprising an engagement portion formed to the skirt member on the lengthwise side wall on a second surface thereof opposite the first surface, and flexibly bendable away from the protrusion.

16. A stamp device as claimed in claim 15, wherein the stamp body has a rectangular shape with four corner portions at its base portion and includes guide portions formed at the corner portions so as to protrude away from the grip, pairs of the guide portions confronting each other with respect to the ink impregnated body being separated by a distance substantially equal to a width of the stencil sheet, the stencil sheet being fitted between the pairs of the guide portions.

17. A stamp device as claimed in claim 16, wherein marks are formed on the lengthwise sides of the stamp body, the marks being for aligning lengthwise edges of the stencil sheet.

18. A stamp device as claimed in claim 15, wherein the stamp body is formed with engagement portions and further comprising:

a cap member having:

two side surfaces;

a print face confronting surface between the side surfaces; and engaging holes formed in the side surfaces for engaging with the engagement portions of the stamp body.

19. A stamp device as claimed in claim 18, wherein the cap member is formed from a resilient material and further has ribs formed along edges between the side surfaces and the print face confronting surface so that the side surfaces move apart when the ribs are pinched toward each other.

* * * * *